United States Patent [19]

Snow

[11] 4,234,978

[45] Nov. 25, 1980

[54] COT

[76] Inventor: Bill D. Snow, 3817 Rutledge, Fort Worth, Tex. 76107

[21] Appl. No.: 52,428

[22] Filed: Jun. 26, 1979

Related U.S. Application Data

[63] Continuation-in-part of Ser. No. 934,392, Aug. 17, 1978, abandoned, which is a continuation-in-part of Ser. No. 868,024, Jan. 9, 1978, abandoned, which is a continuation of Ser. No. 718,407, Aug. 30, 1976, abandoned.

[51] Int. Cl.[3] ..... A47C 17/14; A47F 1/00; A47K 3/22

[52] U.S. Cl. ..... 5/111; 4/585; 5/82 R; 5/202; 5/419; 9/348; 297/239; 297/457

[58] Field of Search ..... 297/239, 457, DIG. 2; 5/93, 82 R, 110, 111, 175, 202, 186, 400, 419, 420; 4/177, 185, 14 B; 9/348; D23/52

[56] References Cited

U.S. PATENT DOCUMENTS

| | | | |
|---|---|---|---|
| 2,828,489 | 4/1958 | Baker | 297/457 |
| 2,936,826 | 5/1960 | Reinemar | 297/457 |
| 2,957,184 | 10/1960 | Smith | 297/457 |
| 3,135,972 | 6/1964 | Jakes et al. | 5/82 |
| 3,449,776 | 6/1969 | Brook | 5/82 |
| 3,633,222 | 1/1972 | Greenfield | 297/457 |
| 3,729,752 | 5/1973 | Huggins | 5/93 R |
| 3,835,482 | 9/1974 | Tersch | 9/348 |

FOREIGN PATENT DOCUMENTS

| | | | |
|---|---|---|---|
| 1342629 | 1/1974 | United Kingdom | 5/420 |

*Primary Examiner*—Casmir A. Nunberg
*Attorney, Agent, or Firm*—Wofford, Fails & Zobal

[57] ABSTRACT

A light weight, two piece cot comprising first and second rectangular shaped molded members which form a contoured surface for supporting a person when fitted together. Each member has two sides and two ends and an upward facing surface with a ridge formed around said surface along two sides and one end. The first member is elongated having four walls along its two sides and two ends respectively for supporting its upward facing surface and the second member has three walls along its two sides and along said one end respectively for supporting its upward facing surface. The ridge free end of the second member is supportable by the ridge free end of the first member.

6 Claims, 14 Drawing Figures

Fig. 1
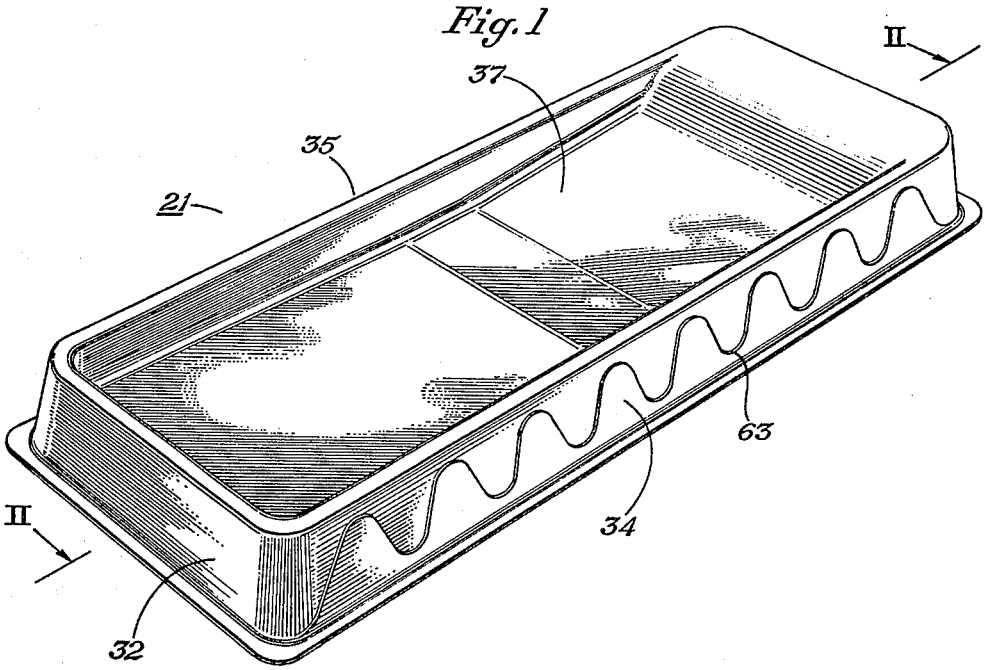
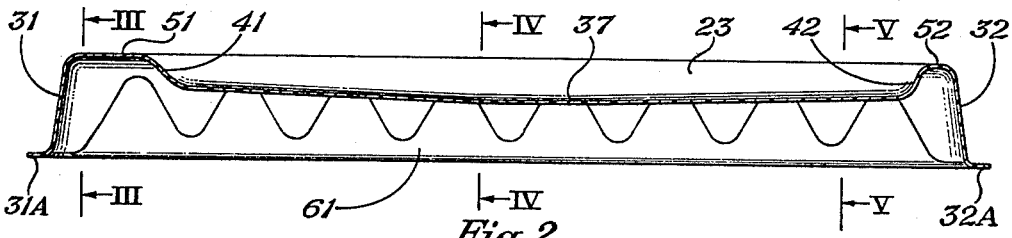
Fig. 2
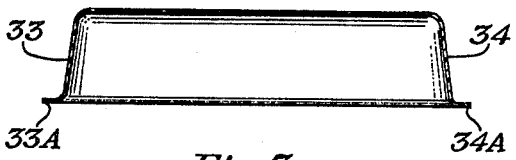
Fig. 3
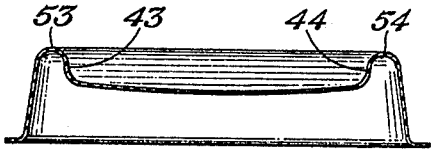
Fig. 4
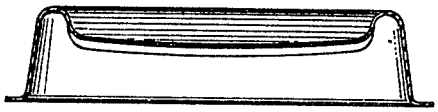
Fig. 5

129A
139
145
123
135
121
133
149
150
10
9
128
163B
163
164
183
169
167
179
8
125
161
181
175
165B
173
177
171
163
163B
143
151
137A
137
127
129
129B
143A
135A
135
141
147
147A
141A
153
131B

COT

This application is a continuation-in-part of U.S. Pat. application Ser. No. 934,392 now abandoned filed Aug. 17, 1978. U.S. Pat. application Ser. No. 934,392 is a continuation-in-part of U.S. Pat. application Ser. No. 868,024 now abandoned filed Jan. 9, 1978. U.S. Pat. application Ser. No. 868,024 is a continuation of U.S. Pat. application Ser. No. 718,407 now abandoned filed Aug. 30, 1976.

BACKGROUND OF THE INVENTION

Conventional cots are made with wood, steel, or aluminum frames with cloth fabric or springs stretched between the frames for support purposes. These cots are costly, having several pieces held together by fasteners which become a hazard and require maintenance. Handling and stacking also is a problem with conventional cots since they require a great amount of storage space when not in use. Cleaning conventional cots by washing and air drying also requires much time and renders the cots unusable for extended periods of time while drying.

SUMMARY OF THE INVENTION

It is an object of the present invention to provide a cot which is attractive, light weight, comfortable, economic, easy to clean, and which requires less space than the conventional cot and which also may be readily stacked in a minimum amount of space with other such cots when not in use.

It is a further object of the present invention to provide a two-piece cot comprising first and second molded members which form a contoured surface for supporting a person when fitted together. When not in use or in shipping, a plurality of the first members may be nested and stacked together and a plurality of the second members may be nested and stacked together to minimize space.

BRIEF DESCRIPTION OF DRAWINGS

FIG. 1 is a perspective view of the cot described and claimed in U.S. Pat. application Ser. No. 934,392;

FIG. 2 is a cross-section of FIG. 1 taken along the lines 2—2 thereof;

FIG. 3 is a cross-section of FIG. 2 taken along the line 3–4 thereof;

FIG. 4 is a cross-section of FIG. 2 taken along the lines 4—4 thereof; and FIG. 5 is a cross-section of FIG. 2 taken along the lines 5—5 thereof;

Figures 6, 7A, 7B, 8, 9, 10:
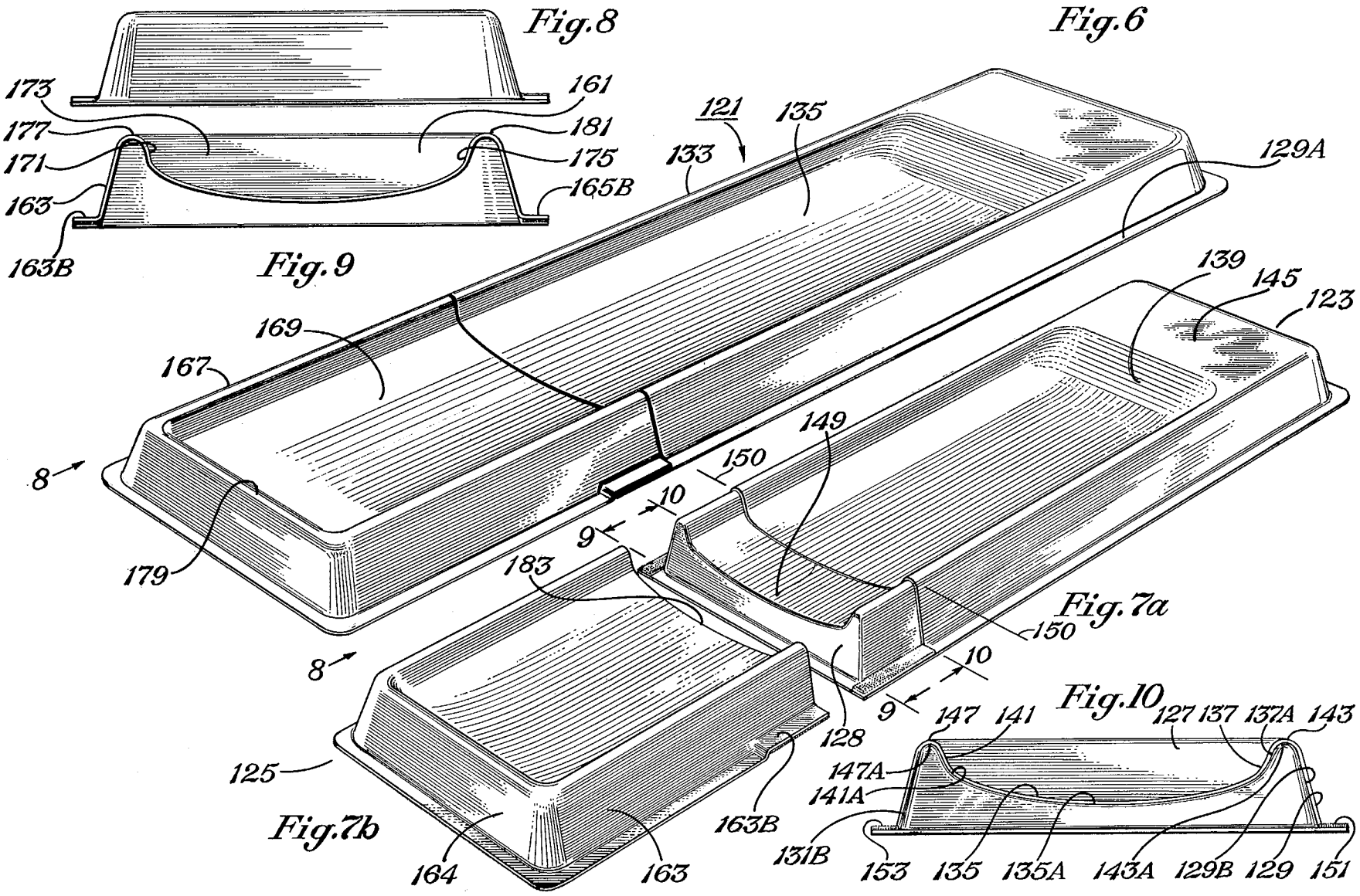
FIG. 6 is a perspective view of the top side of the cot of the present invention.
Figures 11, 12A, 12B:
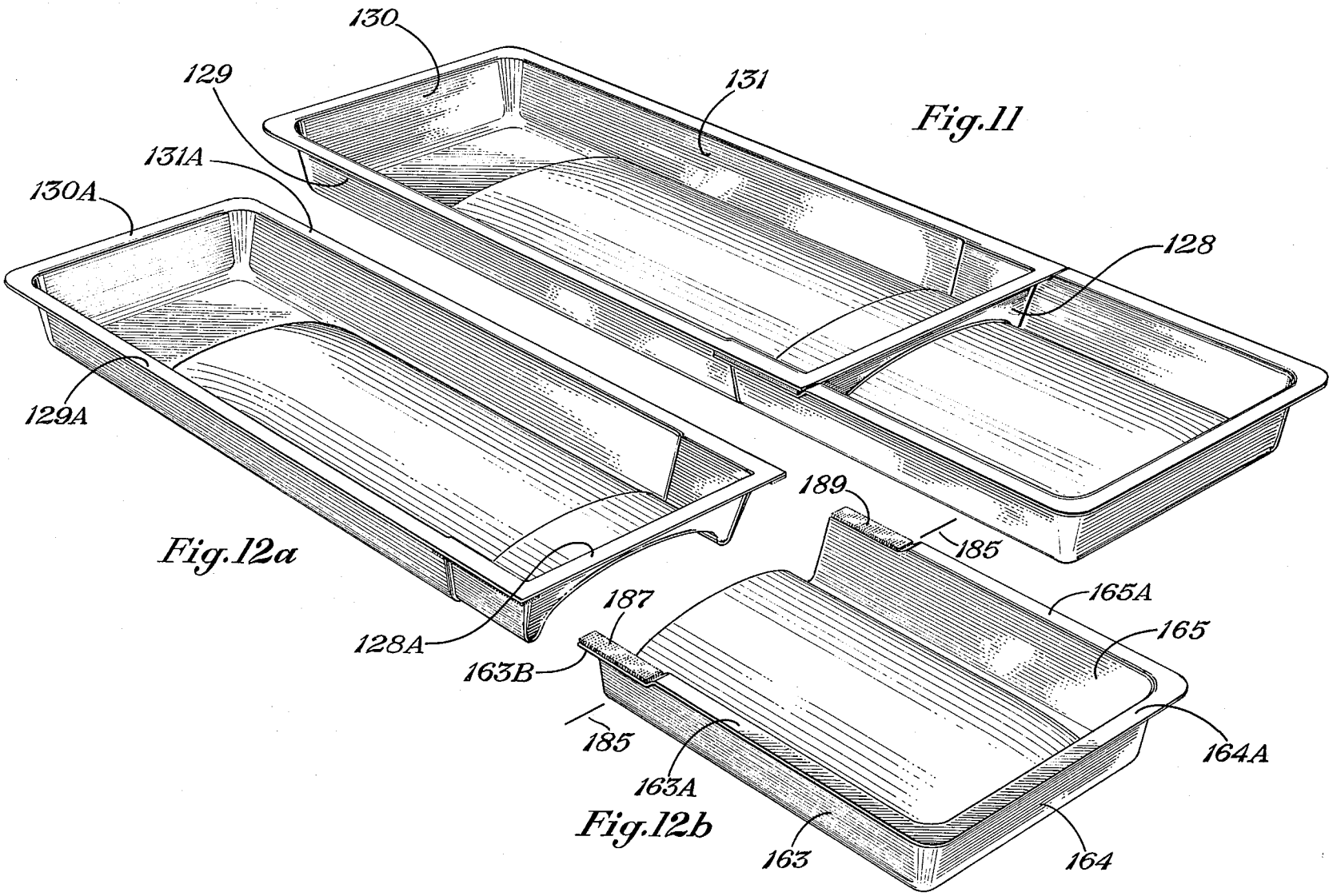

FIGS. *7a* and *7b* are an exploded view of the cot of the present invention as seen from the top side;

FIG. 8 is a view of FIG. 6 taken along the lines 8—8 thereof;

FIG. 9 is a view of FIG. *7b* taken along the lines 9—9 thereof;

FIG. 10 is a view of FIG. *7a* taken along the lines 10—10 thereof;

FIG. 11 is a perspective view of the bottom side of the cot of the present invention; and FIGS. 12*a* and 12*b* are an exploded view of the cot of the present invention as seen from the bottom side.

DESCRIPTION OF THE PREFERRED EMBODIMENTS

Referring now to FIGS. 1–5 of the drawings, the cot is identified by reference numeral 21 and is a one piece member molded from a thin sheet of plastic. The cot comprises a generally rectangular shaped top wall structure 23 having four supporting side walls 31, 32 33 and 34 extending downward from the top wall structure. The four supporting side walls have bottom edges 31A, 32A, 33A and 34A which flange outward in a flat plane for engaging the floor of a house or building for supporting the top wall structure 23 above and spaced from the floor. The four supporting side walls are integral with each other such that the cot when supported on the floor in the manner shown in FIG. 1 forms an air cushion. The top wall structure 23 comprises a ridge 35 surrounding a rectangular shaped upward facing sleeping surface 37 which is located at a level between the upper edge of the ridge 35 and bottom edges 31A–34A. The sleeping surface 37 is supported by the ridge 35 which comprises four inner side wall portions 41, 42, 43 and 44, the upper edges of which are connected to the upper edges of the side walls 31–34 by way of upper wall portions 51, 52, 53 and 54 respectively. As seen in the drawings, the wall portions 52–53 are narrow rounded portions while the wall portion 51 is flat forming a head rest for the person lying on the sleeping surface 37. The surface 37 also slopes downward toward the center from all four sides forming a comfortable and resilient sleeping surface. The sleeping surface 37 with the four supporting inner walls 41–44 in effect define a supporting cradle which is waterproof. It is noted further that the four side walls 31–34 flare outward whereby several cots may be stacked together, one nested within the other. Nesting is carried out by inserting the top of one cot within the bottom opening 61, formed between the side walls, of another cot.

The cot of FIGS. 1–5 is primarily intended for use for small children. In one embodiment, the cot has a width of 24 inches, a length of 53½ inches and height of 5½ inches. The head rest 51 has dimensions of about 20 inches by 5 inches. Ridges 53 are for structural support purposes although they form a pleasing design. They are not illustrated in FIGS. 3–5. The cot is formed by vacuum molding of a sheet of thermoplastic such as ABS, styrene, polyethylene, polypropylene, etc. The cot could also be injection molded. The walls have a thickness of about 1/16th of an inch and the total weight of the cot is 6½ pounds. Although the walls are thin and flexible and the unit is light in weight, it has been found that the cot will support more than 8 times the weight of an average child.

Since the cots are light weight, stacking may be carried out easily by the children themselves. Fifty cots may be stacked in less than 30 inches. Thus, it can be seen that the cots may be stored in a minimum amount of space when not in use. When the cots are stacked the sleeping surfaces do not touch. It has been found that each cot takes up 12% less floor space than the conventional cot thereby providing more potential accomodations for children on existing floor space. The cots are sturdy and stable and require no screws or bolts, legs or other parts that require replacement or maintenance. Thus, there are no parts to wear out and no parts to mar the floor. The cot may be readily cleaned by wiping with a mild detergent. By forming the cot as a one piece molded member, the cot can be sold for ⅓ less than the cost of the conventional cot. In use the cot is merely placed on the floor with its flanges 31A–34A engaging the floor surface. In this position, the cot traps dead air underneath for warmth and draft free use. Although the cot is quite comfortable without pads or sheets, they can be easily used if so desired. The head rest 51 and contour design cradle the child in secure cushioned comfort. Since the cot is lower to the floor, it has been found that it is a new and fun experience for children. Moreover, the low profile makes it safer than the conventional cot since there are no protruding legs or metal frames to trip over or collide with. The children may fit their shoes under the cot so as to remove additional tripping hazards.

Referring now to FIGS. 6–12 there will be described a cot primarily intended for use for adults although it is to be understood that it may also be used by children. It has useful application particularly in emergency situations such as natural disasters due to hurricanes, floods etc.

The cot of FIGS. 6–12 is identified by reference numeral 121 and is formed of two members 123 and 125 molded of thin sheets of plastic. Member 123 is an elongated rectangular shaped member comprising a top wall structure 127 having four supporting side walls 128, 129, 130, and 131 extending downward from the top wall structure 127. The four supporting side walls have bottom edges 128A, 129A, 130A and 131A which flange outward in a flat plane for engaging the floor of a house or building for supporting the top wall structure 127 above the spaced from the floor. The four supporting side walls are integral with the top wall structure 127 and adjacent side walls are integral with each other such that the member 123 when supported on the floor as shown in FIGS. 6 and *7a* forms an air cushion.

The top wall structure 127 comprises a ridge 133 which extends around two sides and an end of a rectangular shaped upward facing surface 135 which is located at a level between the upper edge of the ridge 133 and the bottom edges 128A, 129A, 130A and 131A. The surface 135 forms a portion of the surface for supporting a person when the two members 123 and 125 are fitted together as will be described subsequently. The surface 135 is supported by the ridge 133 which comprises three inner side wall portions 137, 139 and 141, the upper edges of which are connected to the upper edges of the side walls 129, 130 and 131 by way of upper wall portions 143, 145, and 147 respectively. As seen in the drawings, the wall portions 143 and 147 are narrow rounded portions while the wall portion 145 is flat forming a head rest. The surface 135 slopes downward toward the center from inner side wall portions 137 and 141. It also slopes downward from inner side wall portion 139 toward the end 149. This is more clearly shown in FIG. *7a*. As seen, the end 149 has no ridge formed across it and may be defined as a ridge free end. From the ridge free end 149 to a cross-sectional plane defined by lines 150 the side wall portions 129B and 131B are offset inward from side walls 129 and 131 and the surface portion 135A is offset downward from surface 135. In addition top wall portions 143A and 147A are offset downward from top wall portions 143 and 147 and inner side wall portions 137A and 141A are offset outward from inner side wall portions 137 and 141. Two Velcro strips 151 and 153 are attached to flanges 129A and 131A from the plane 150 to the end 149.

Member 125 is a rectangular shaped member comprising a top wall structure 161 having three supporting side walls 163, 164 and 165 extending downward from the top wall structure 161. The three supporting side walls have bottom edges 163A, 164A, and 165A which flange outward in a flat plance for engaging the floor of a house or building for supporting the top wall structure 161 above and spaced from the floor. The three supporting side walls 163, 164 and 165 are integral with the top wall structure 161 and adjacent side walls are integral with each other.

The top wall 161 comprises a ridge 167 which extends around two sides and an end of a rectangular shaped upward facing surface 169 which is located at a level between the upper edge of the ridge 167 and the bottom edges 163A, 164A, and 165A. The surface 169 along with surface 135 forms a surface for supporting a person when the two members 123 and 125 are fitted together. The surface 169 is supported by the ridge 167 which comprises three inner side wall portions 171, 173 and 175, the upper edges of which are connected to the upper edges of the side walls 163, 164, and 165 by way of upper wall portions 177, 179, and 181 respectively. Upper wall portions 177, 179, and 181 are narrow rounded portions. The surface 169 slopes downward towards the center from inner side wall portions 171 and 175. It also slopes downward from inner side wall portions 173 toward the end 183. This is more clearly shown in FIG. *7b*. As seen, the end 183 has no ridge formed across it and may be defined as a ridge free end. From the ridge free end 183 to a cross-sectional plane defined by lines 185, flange portions 163B and 165B are off set upward from flanges 163 and 165 and have Velcro strips 187 and 189 attached to their underside.

The two members 123 and 125 are fitted together to form the cot of FIG. 6 by nesting the ridge free end 183 of member 125 on the ridge free end 149 of member 123 as shown in FIG. 6. The Velcro strips 151, 153 and 187, 189 hold the two members 123 and 125 together.

The walls of both of members 123 and 125 have the same thickness. The amount of off set from plane 150 to end 149 is about equal to the thickness of the walls. The distance from end 149 to plane 150 is equal to the distance from end 183 to plane 185. Except for the flanges, member 125 from its end 183 to plane 185 has about the same cross-sectional shape and dimensions as member 123 from plane 150 toward the right a short distance as seen in FIG. *7a*. Thus when the end 183 of member 125 is nested about the end 149 of member 123 an amount such that the portion from end 183 to plane 185 overlap end 149 to plane 150, the surfaces 169 and 135 form a continuous surface for supporting a person. In addition the ridges 133 and 167 along the length of the cot on each side and the sides 163, 129 and 131, 165 are continuous.

The surface 135 of memer 123 with its four supporting side walls 128–131 is strong enough to support an adult person. When the member 125 is not fitted to member 123, the surface 169 of member 125 at the end 183 is not strong enough to support a person. When the end 183 of member 125 is nested on the end 149 of member 125, however, sufficient support is provided for supporting an adult person on surface 169.

Thus by providing the two members 123 and 125 as shown and described, a cot similar in shape to cot 21 may be formed with a length much longer than cot 21 yet strong enough to support an adult person up to 350 pounds. Its length may be extended by nesting end 183 over end 149 such that end 183 is located between plane 150 and end 149 rather than at the plane 150.

The four walls 128–131 of members 123 flare outward whereby several members 123 may be stacked together, one nested within the other. In addition the three walls 163–165 of member 125 flare outward whereby several members 125 may be stacked together one nested within the other.

In one embodiment members 123 and 125 each have a height of about 5¼ inches. The width of member 123 measured from the base of wall 129 to the base of wall 131 is about 22½ inches. The width of member 123 at its top is about 20½ inches. The length of member 123 measured from the base of wall 128 to the base of wall 130 is about 52 inches. The length of member 123 at its top is about 50½ inches. The head rest 145 has a dimension of about 20½ inches by 8 inches. The distance from the base of wall 128 to plane 150 is about 5 inches. The flanges 128A–131A have a width of about ¾ of an inch. The width of member 125 measured from the base of wall 163 to the base of wall 165 is about 22½ inches. The width of member 123 at its top is about 20½ inches. The length of member 125 at its base is about 24¾ inches and at its top is about 24 inches. The distance from end 183 to plane 185 is about 6 inches. The flanges 163A–165A have a width of about ¾ of an inch. Members 123 and 125 are formed by vacuum molding sheets of thermoplastic such as ABS, styrene, polyethylene, polypropylene, etc. The members 123 and 125 could also be injection molded. The walls of members 123 and 125 have a thickness of about 1/16 of an inch or slightly greater. Although the walls are thin and flexible and the cot formed of members 123 and 125 is light in weight, it will support an adult person up to 350 pounds.

I claim:

1. A two piece cot or the like, comprising:

first and second members, said first member comprising:

top wall means having four supporting side walls extending downward from said top wall means for engaging the floor of a house or building for supporting said top wall means above and spaced from the floor, said top wall means comprising:

an upward facing surface having a ridge extending around three sides thereof, whereby the fourth side has a ridge free edge, said upward facing surface being located at a level between the upper edge of said ridge and the bottom edges of said side walls, three inner side wall portions extending upward from said three sides of said upward facing surface, said ridge being defined by ridge wall portions connecting the upper edges of said three inner side wall portions with the upper edges of said supporting side walls of said three sides respectively, said second member comprising:

top wall means having three supporting side walls extending downward from said top wall means of said second member for engaging the floor of a house or building for supporting said top wall means of said second member above and spaced from the floor, said top wall means of said second member comprising:

an upward facing surface having a ridge extending around three sides thereof such that the fourth side has a ridge free edge with no supporting sidewall, said upward facing surface of said second member being located at a level between the upper edge of said ridge of said second member and the bottom edges of said side walls of said second member, three inner side wall portions extending upward from said three sides of said upward facing surface of said second member, said ridge of said second member being defined by ridge wall portions connecting the upper edges of said three inner side wall portions of said second member with the upper edges of said supporting side walls of said three sides respectively, the ridge free edge of the fourth side of said second member being supportable by the ridge free edge of the fourth side of said first member.

2. The two piece cot of claim 1 wherein:

said first and second members are generally rectangular in shape, said first member having a length greater than its width, the ridge wall portion along with the width of said first member having a flat upper surface with dimensions sufficient to form a head rest for a person lying on said upward facing surfaces of said first and second members.

3. The two piece cot of claim 1 wherein:

said four supporting side walls of said first member flare outward whereby two of said first members may be stacked together, one nested within the other, said three supporting side walls of said second member flare outward whereby two of said second members may be stacked together, one nested within the other.

4. The two piece cot of claim 1 wherein:

the walls of said first and second members are formed of thin flexible material, said first and second members are generally rectangular in shape, said ridge free edge of said first member extends along one side of said first member, said ridge free edge of said second member extends along one side of said second member, the inside surface of said second member at its said one side and extending inward a short distance has generally the same shape as the outside surface of said second member at its said one side and extending inward a short distance whereby said inside surface at said one side of said second member may fit and nest about the outside surface at said one side of said first member.

5. The two piece cot of claim 4, wherein:

said four supporting side walls of said first member have bottom edges comprising outward extending flanges, said three supporting side walls of said second member have bottom edges comprising outward extending flanges, a portion of the flanges of the two sides of said second member adjacent its said one side being adapted to rest on a portion of the flanges of the two sides of said first member adjacent its said one side when said inside surface at said one side of said second member is fitted and nested about the outside surface at said one side of said first member, said portions of said flanges of said two sides of said second member having attaching means coupled to the bottom sides thereof, said portions of said flanges of said two sides of said first member having attaching means coupled to the top sides thereof for mating with the attaching means of said second member when said inside surface of said one side of said second member is fitted and nested about the outside surface at said one side of said first member.

6. The two piece cot of claim 5, wherein:

said upward facing surface, said ridge, and said two sides of said first member extending inward from said one side a short distance, being off set with respect to the remaining portion of said upward facing surface, said ridge, and said two sides of said first member whereby when said inside surface at said one side of second member is fitted and nested about the outside surface of said one side of said first member, the outside surface of said second member at the edge defined by its said one side is generally flush with the remaining portion of the outside surface of said first member.

* * * * *